US009711313B2

(12) United States Patent
Lee

(10) Patent No.: US 9,711,313 B2
(45) Date of Patent: Jul. 18, 2017

(54) INSTANT TRIP APPARATUS OF MOLDED CASE CIRCUIT BREAKER

(71) Applicant: LSIS CO., LTD., Anyang-si, Gyeonggi-do (KR)

(72) Inventor: Kwang Won Lee, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/985,208

(22) Filed: Dec. 30, 2015

(65) Prior Publication Data

US 2016/0196945 A1 Jul. 7, 2016

(30) Foreign Application Priority Data

Jan. 5, 2015 (KR) ..... 10-2015-0000898

(51) Int. Cl.
*H01H 9/00* (2006.01)
*H01H 71/24* (2006.01)
(Continued)

(52) U.S. Cl.
CPC ..... *H01H 71/2472* (2013.01); *H01H 71/40* (2013.01); *H01H 73/48* (2013.01)

(58) Field of Classification Search
CPC ..... H01H 2071/10; H01H 2071/249; H01H 2071/2427; H01H 2071/2472; H01H 3/28
(Continued)

(56) References Cited

U.S. PATENT DOCUMENTS 2,328,458 A 8/1943 Jackson et al.
3,201,659 A * 8/1965 Poulton ..... H01H 71/7463 335/273
(Continued)

FOREIGN PATENT DOCUMENTS

EP 1026717 8/2000
JP 03-119628 5/1991
(Continued)

OTHER PUBLICATIONS

European Patent Office Application Serial No. 15203163.9, Search Report dated May 20, 2016, 8 pages.
(Continued)

*Primary Examiner* — Shawki S Ismail
*Assistant Examiner* — Lisa Homza
(74) *Attorney, Agent, or Firm* — Lee, Hong, Degerman, Kang & Waimey PC

(57) ABSTRACT

The instant trip apparatus of the molded case circuit breaker includes a case, a magnet part disposed in the case to generate magnetic attractive force when accident current flows therethrough, an armature disposed to face the magnet part, the armature rotating to the magnet part by the magnetic attractive force, an armature spring for allowing the armature to elastically return to its original position when the magnetic attractive force is removed, and a gap maintenance part restricting the rotation of the armature so that a gap defined between the armature and the magnet part is maintained when the accident current occurs. The gap maintenance part includes a rotation restriction member that is disposed to be exposed to an armature rotation path between the armature and the magnet part. Thus, fusion between the armature and the magnet part due to the accident current occurs may be prevented.

14 Claims, 12 Drawing Sheets

(51) Int. Cl.
*H01H 71/40* (2006.01)
*H01H 73/48* (2006.01)

(58) Field of Classification Search
USPC ..... 335/172
See application file for complete search history.

(56) References Cited

U.S. PATENT DOCUMENTS 3,550,047 A 12/1970 Gelzheiser
3,815,064 A * 6/1974 Maier ..... H01H 71/40 335/176
4,691,182 A * 9/1987 Mrenna ..... H01H 71/7418 335/176
4,983,939 A * 1/1991 Shea ..... H01H 71/7463 335/172
6,218,920 B1 * 4/2001 Reichard ..... H01H 71/7463 335/172
6,556,111 B2 * 4/2003 Felden ..... H01H 71/446 335/172
6,744,339 B2 * 6/2004 Daehler ..... H01H 71/2472 335/35
6,774,749 B2 * 8/2004 Raabe ..... H01H 71/2472 335/23
6,788,174 B1 9/2004 Afshari et al.
7,130,173 B2 * 10/2006 Barewz ..... H01H 71/7463 335/35
2003/0197581 A1 * 10/2003 O'Keeffe ..... H01H 71/2436 335/172
2004/0150495 A1 * 8/2004 Lias ..... H01H 71/2472 335/2
2009/0115556 A1 * 5/2009 Faik ..... H01H 71/7463 335/42
2010/0188176 A1 7/2010 Faik et al.
2011/0132875 A1 * 6/2011 Werner ..... H01H 71/16 218/154
2013/0187746 A1 * 7/2013 Augusta ..... H01H 89/00 337/3

FOREIGN PATENT DOCUMENTS

JP 05-12981 1/1993
JP 2000-195400 7/2000
JP 2012-195102 10/2012
KR 10-1012046 1/2011
KR 10-2014-0051775 5/2014
RU 2037232 6/1995
RU 2136074 8/1999
RU 80628 2/2009

OTHER PUBLICATIONS

Korean Intellectual Property Office Application Serial No. 10-2015-0000898, Office Action dated Apr. 1, 2016, 5 pages.
Russian Federation Federal Service for Intellectual Property, Patents and Trademarks Application Serial No. 2015155755/07, Notice of Allowance dated May 15, 2017, 10 pages.

* cited by examiner

PRIOR ART

PRIOR ART

INSTANT TRIP APPARATUS OF MOLDED CASE CIRCUIT BREAKER

CROSS-REFERENCE TO RELATED APPLICATIONS

Pursuant to 35 U.S.C. §119(a), this application claims the benefit of earlier filing date and right of priority to Korean Patent Application No. 10-2015-0000898, filed on Jan. 5, 2015, the contents of which are hereby incorporated by reference herein in its entirety.

BACKGROUND

The present disclosure relates to an instant trip apparatus of a molded case circuit breaker, and more particularly, to an instant trip apparatus of a molded case circuit breaker, which is capable of preventing a magnet and an armature from being fused with each other to secure reliability in effective instant trip operation.

A molded case circuit breaker may be electric equipment that breaks abnormal current, i.e., overcurrent, fault current, or short-circuit current between a power and a load when the abnormal current occurs to protect the load and a circuit.

The molded case circuit breaker may have a trip function in which, when the abnormal current occurs, the molded case circuit breaker detects the abnormal current therein to automatically break the abnormal current.

The trip function may be classified into temporary trip and instant trip. In the temporary trip, a circuit breaking operation may be performed after a predetermined time elapses when the abnormal current occurs. Unlike the temporary trip, in the instant trip, the circuit breaker may detect relatively large accident current to break the circuit in the short time.

The trip operation of the molded case circuit breaker with respect to the accident current may be performed for a predetermined time (for example, about 10 mille seconds) by detecting current when circuit current flowing through the molded case circuit breaker is instantaneously applied at a predetermined multiplying factor (e.g., about 200%, about 300%, about 1,000%, about 2,000%, etc.) than rated current.

A mechanism for performing the instant trip may be called an instant trip apparatus.

An instant trip operation will be described through the instant trip apparatus of the molded case circuit breaker according to the related art.

FIG. 1 is a view of an instant trip apparatus of a molded case circuit breaker according to the related art, and FIG. 2 is a view illustrating an instant trip operation in the instant trip apparatus of the molded case circuit breaker according to the related art.

Referring to FIG. 1, the instant trip apparatus of the molded case circuit breaker according to the related art includes a case 10, a heater 11, a bimetal 12, a crossbar 51, a magnet 20, and armature 31.

The heater 11 is installed in the case 10. The heater 11 may enable current to be transmitted therethrough, have uniform resistance, and generate heat according to an amount of flowing current.

The bimetal 12 is installed in the case 10. When current flowing through the heater 11 is over rated current (overcurrent), the bimetal 12 is bent by the generated heat to push the crossbar 51 so that the crossbar 51 rotates to a trip position.

The crossbar 51 may rotate in a left/right direction between the trip position and a normal position according to the rotation operation and also return to the normal position by elastic restoring force of a crossbar spring 52 installed at a rotation center.

Here, in the normal position, the crossbar 51 may have an upper end spaced apart from one side of an upper end of the bimetal 12 and a lower end extending downward.

The magnet 20 is installed in the case 10 to face armature 20. The magnet 20 is electrically connected to the circuit to generate magnetic attractive force when the accident current occurs.

The armature 31 is installed in the case 10 to face one surface of the magnet 20. A lower end of the armature 31 is rotatably supported by a support 32 to horizontally rotate.

The armature 31 is rotatable between a position at which the armature 31 contacts the magnet 20 and a position at which the armature 31 is spaced apart from the magnet 20.

The armature 31 is formed of a material containing iron. When the magnetic attractive force is generated by the magnet 20, the armature 31 rotates to contact one surface of the magnet 20.

Also, the armature 31 has an upper end that is elastically connected to the armature spring 33 installed in the case 10 to return to its original position from the position at which the armature 31 is spaced apart from the magnet 20.

Here, non-explained reference numeral "31a" denotes a rotation shaft of the armature 31, and reference numeral "34" denotes a support member to which an end of the spring 33 is connected.

Referring to FIG. 2, when the accident current that is significantly higher than the rated current flows through the heater 11, the magnet 20 may be excited to generate the magnetic attractive force.

Then, the armature 31 that is rotatably installed on a side of the magnet 20 rotates in a clockwise direction by using the support 32 as a rotation center to contact one surface of the magnet 20.

Simultaneously, the rotating armature 31 presses a lower end of the crossbar 51 that is disposed at the normal position. Then, the crossbar 51 is pushed by the rotating armature 31 to rotate in a counterclockwise direction.

Thus, since the crossbar 51 rotates from the normal position to the trip position, the instant trip operation may be realized.

The rotation of the armature 31 as described above may be stopped when the armature 31 contacts one surface of the magnet 20.

Thereafter, when the accident current is broken through the above-described instant trip operation, the armature 31 rotates to return to its original position by the elastic restoring force of the armature spring 33. Also, the contact between the armature 31 and the crossbar 51 is released, and the armature 31 rotates to return to the normal position by the elastic restoring force of the crossbar spring 52.

In the above-described operation, the armature 31 may rotate by the magnetic attractive force generated by the magnet 31 when the accident current occurs to physically contact the one surface of the magnet 31.

Generally, in this case, the accident current may flow along an arrow expressed as a dotted line through the heater 11 illustrated in FIG. 3.

However, when the rated current is less, and the heater 11 has high resistance, as illustrated in FIG. 4, the accident current may flow along the following path: the support 32->the armature 31->the magnet 20, which have resistance less than that of the heater 11.

When the accident current flow via the armature 31 and the magnet 20, which are in contact with each other, arc may be generated at the contact portion between the armature 31 and the magnet 20. Here, the arc generation portion may be fused.

Thus, the fused state between the armature 31 and the magnet 20 may be maintained, and also, the rotation operation of the crossbar 51 at the lower end of the armature 31 may be restricted so that the crossbar 51 does not return to the normal position.

When the crossbar 51 does not return to the normal position, the molded case circuit breaker may be continuously maintained in the trip state. Thus, after the accident current is removed, the molded case circuit breaker may not perform the normal instant trip operation.

There is Korean Patent Publication No. 10-2006-0101035 as the related prior document. An instant trip apparatus of a molded case circuit breaker is disclosed in Korean Paten Publication No. 10-2006-0101035.

SUMMARY

Embodiments provide an instant trip apparatus of a molded case circuit breaker, which is capable of preventing a magnet for generating magnetic attractive force and an armature from being fused due to contact therebetween when accident current flows to secure reliability in effective instant trip operation.

In one embodiment, instant trip apparatus of a molded case circuit breaker includes: a case; a magnet part disposed in the case to generate magnetic attractive force when accident current flows therethrough; an armature disposed to face the magnet part, the armature rotating to the magnet part by the magnetic attractive force; an armature spring for allowing the armature to elastically return to its original position when the magnetic attractive force is removed; and a gap maintenance part restricting the rotation of the armature so that a gap defined between the armature and the magnet part is maintained when the accident current occurs, wherein the gap maintenance part includes a rotation restriction member that is disposed to be exposed to an armature rotation path between the armature and the magnet part.

The rotation restriction member may have a thickness for defining the gap.

The rotation restriction member may be disposed to protrude from the case to the armature rotation path.

The instant trip apparatus may further include a heater disposed in a bottom surface of an inner space of the case, wherein the magnet part may be disposed above the heater, and the rotation restriction member may be longitudinally disposed in a direction perpendicular to a top surface of the heater.

The rotation restriction member may have a plate shape and surface-contacts one surface of the armature that rotates to a position for defining the gap.

The rotation restriction member may include an inclined plate that is inclinedly disposed on the case to surface-contact one surface of the armature.

A portion of the rotation restriction member may include an inclined plate that is inclined to surface-contact one surface of the armature rotating to a position for defining the gap.

The inclined plate may have a lower end that is inclined to an empty space defined under the magnet part.

The rotation restriction member may further include a vertical plate that is longitudinally disposed in a vertical direction, and the inclined plate may be bent from a lower end of the vertical plate at an obtuse angle with respect to the vertical plate.

The rotation restriction member may include: a protrusion disposed in the armature rotation path; and an auxiliary rotation restriction member detachably inserted into the protrusion.

The protrusion may have a cylindrical shape, and the auxiliary rotation restriction member may have a ring shape.

The protrusion may be disposed to be spaced apart from each of the magnet part and the armature in the armature rotation path.

The auxiliary rotation restriction member may be provided in plurality, and the plurality of auxiliary rotation restriction members may have diameters that increase in stages.

The gap maintenance part may be disposed on a surface of both surfaces of the armature, which faces the magnet part and may further include an insulation member formed of an insulation material.

The instant trip apparatus may further include a crossbar disposed to be rotatable between the original position and a trip position in the case, the crossbar rotating to the trip position by the armature, wherein the insulation member may be disposed on a portion of one surface of the armature except for a portion at which the armature contacts the crossbar.

In another embodiment, an instant trip apparatus of a molded case circuit breaker includes: a case; a magnet part disposed in the case to generate magnetic attractive force when accident current flows therethrough; an armature disposed to face the magnet part, the armature rotating to the magnet part by the magnetic attractive force; an armature spring for allowing the armature to elastically return to its original position when the magnetic attractive force is removed; and a gap maintenance part maintaining a gap defined between the armature and the magnet part when the accident current occurs, wherein the gap maintenance part is disposed on a surface of both surfaces of the armature, which faces the magnet part and may include an insulation member formed of an insulation material and having a thickness for defining the gap.

When the armature rotates to the magnet part, the insulation member may surface-contact the magnet part.

The insulation member may be provided in plurality, and the plurality of insulation members may be disposed to be spaced apart from each other on one surface of the armature.

The insulation member may have a plate shape to cover a portion of one surface of the armature.

The instant trip apparatus may further include a crossbar disposed to be rotatable between the original position and a trip position in the case, the crossbar rotating to the trip position by the armature, wherein the insulation member is disposed on a portion of one surface of the armature except for a portion at which the armature contacts the crossbar.

The details of one or more embodiments are set forth in the accompanying drawings and the description below. Other features will be apparent from the description and drawings, and from the claims.

DETAILED DESCRIPTION OF THE EMBODIMENTS

Hereinafter, an instant trip apparatus of a molded case circuit breaker according to an embodiment will be described with reference to the accompanying drawings.

Figure 1:
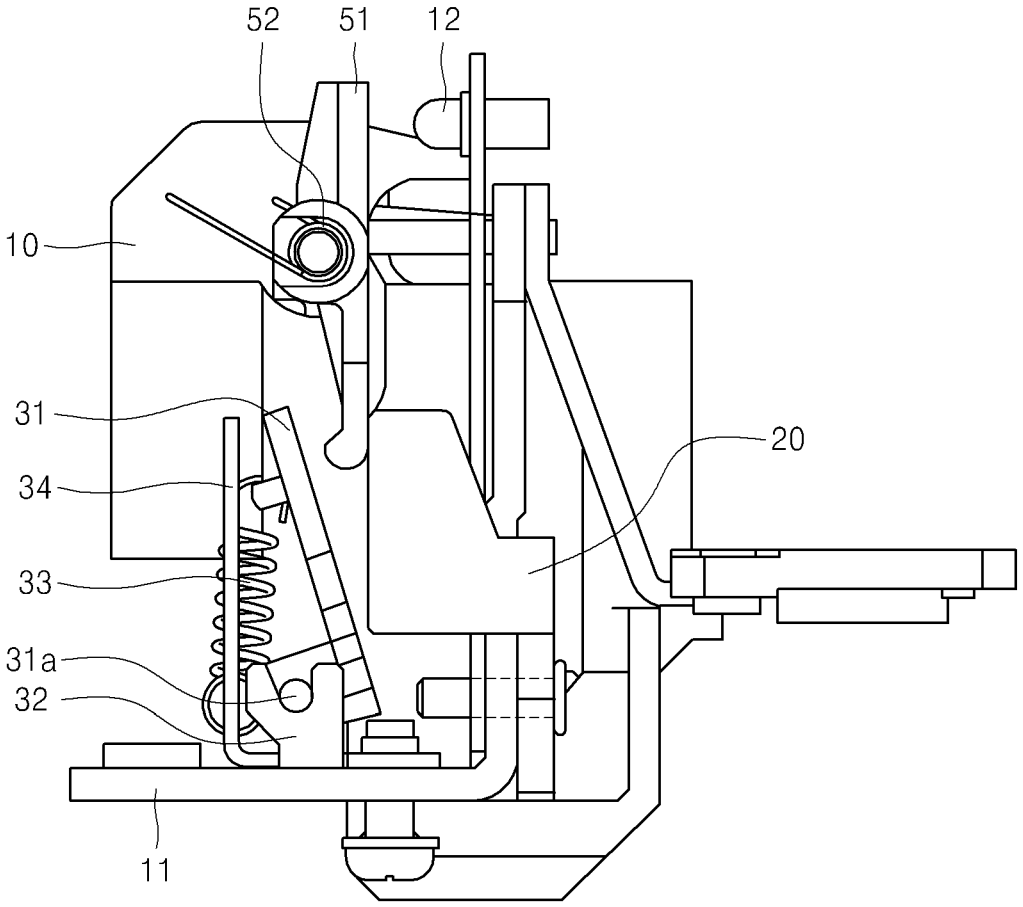
FIG. 1 is a view of an instant trip apparatus of a molded case circuit breaker according to a related art.
Figure 2:
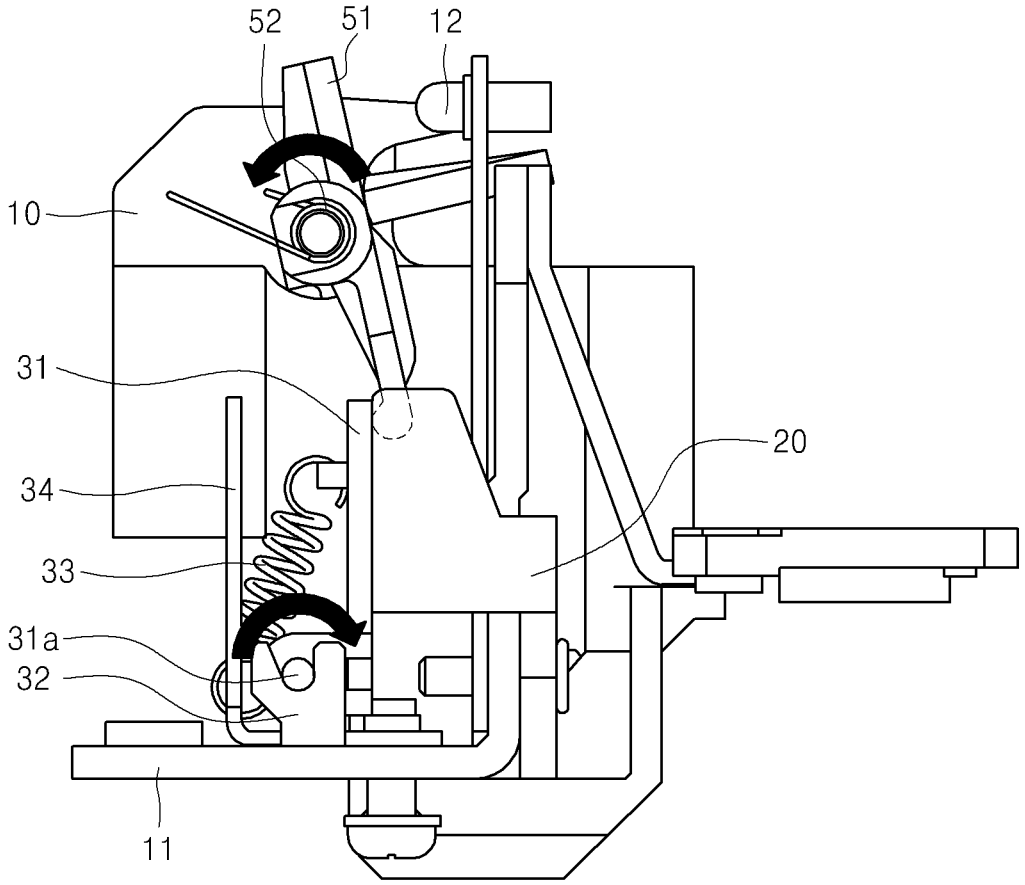
FIG. 2 is a view illustrating an instant trip operation in the instant trip apparatus of the molded case circuit breaker according to the related art.
Figure 3:
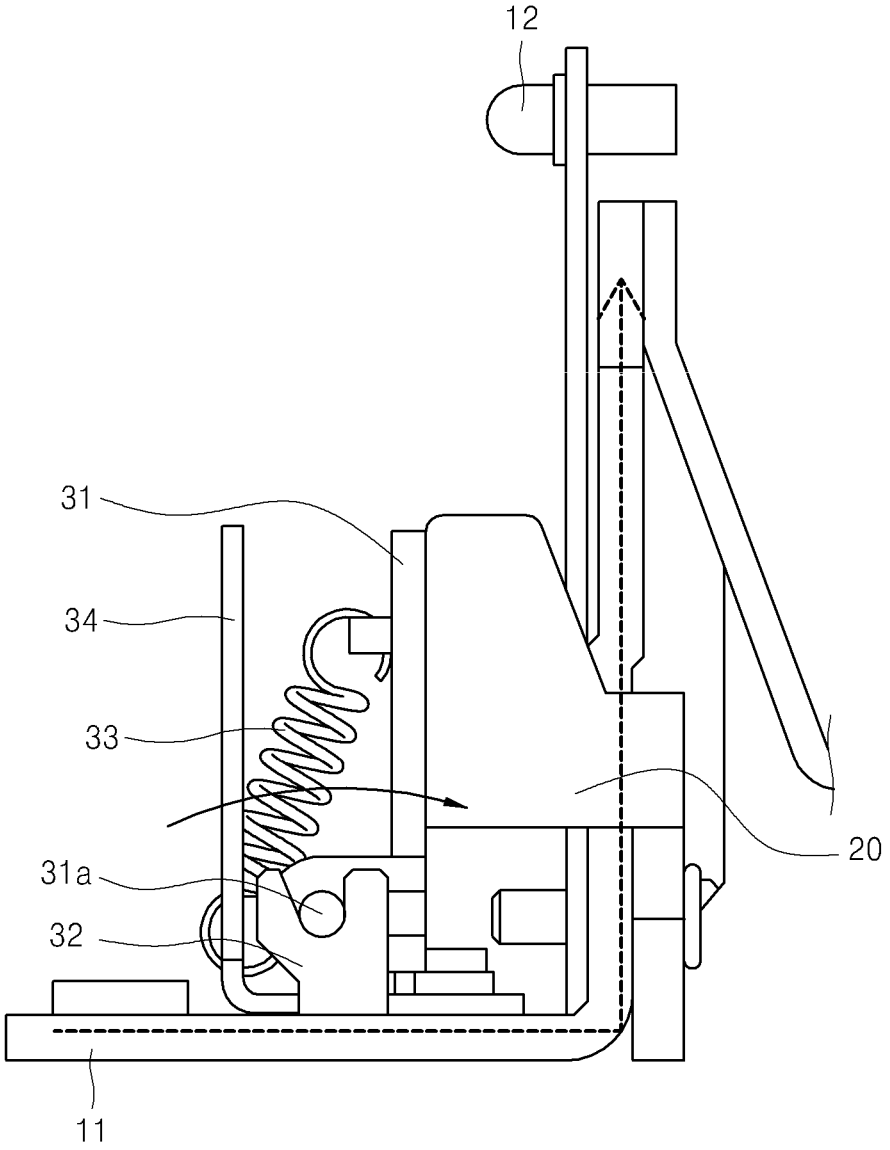
FIG. 3 is a view of a first current flow path of accident current.
Figure 4:
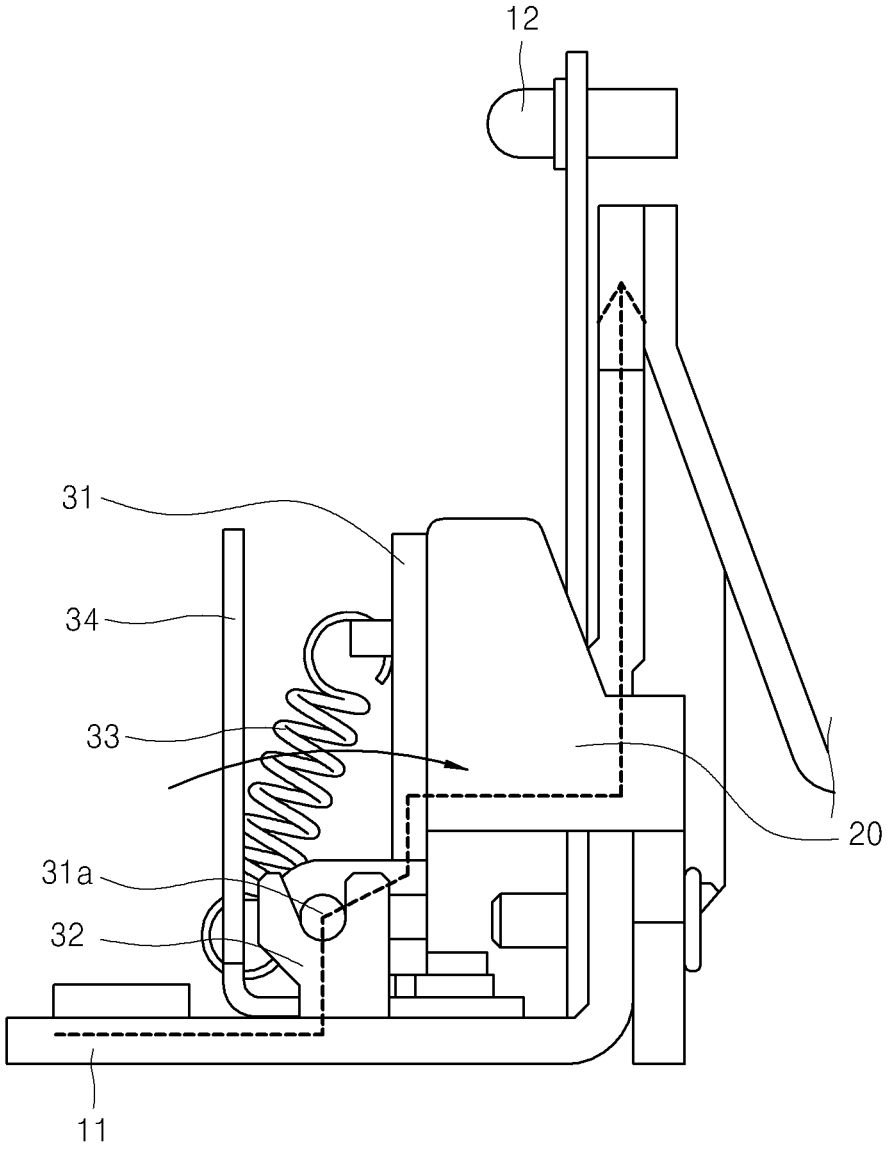
FIG. 4 is a view of a second current flow path of the accident current.
Figure 5:
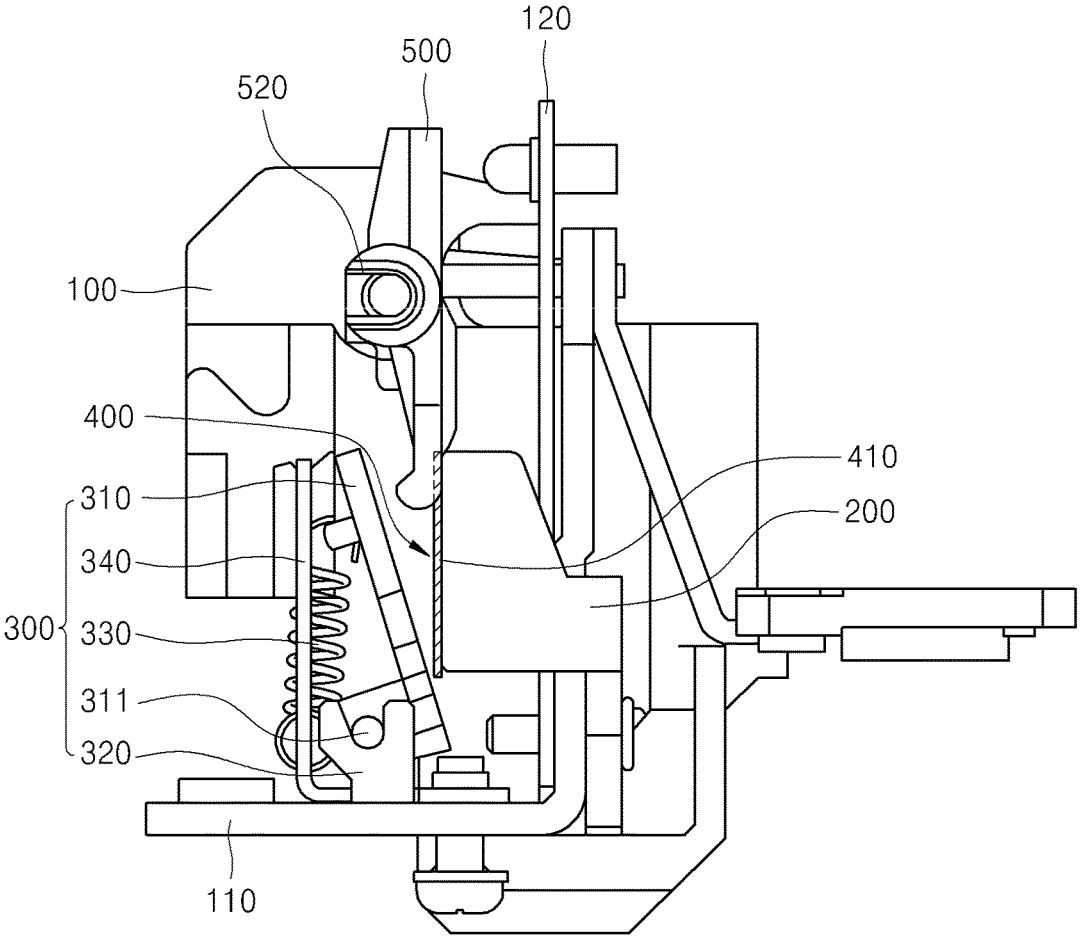
FIG. 5 is a view of an instant trip apparatus of a molded case circuit breaker according to an embodiment.
Figure 6:
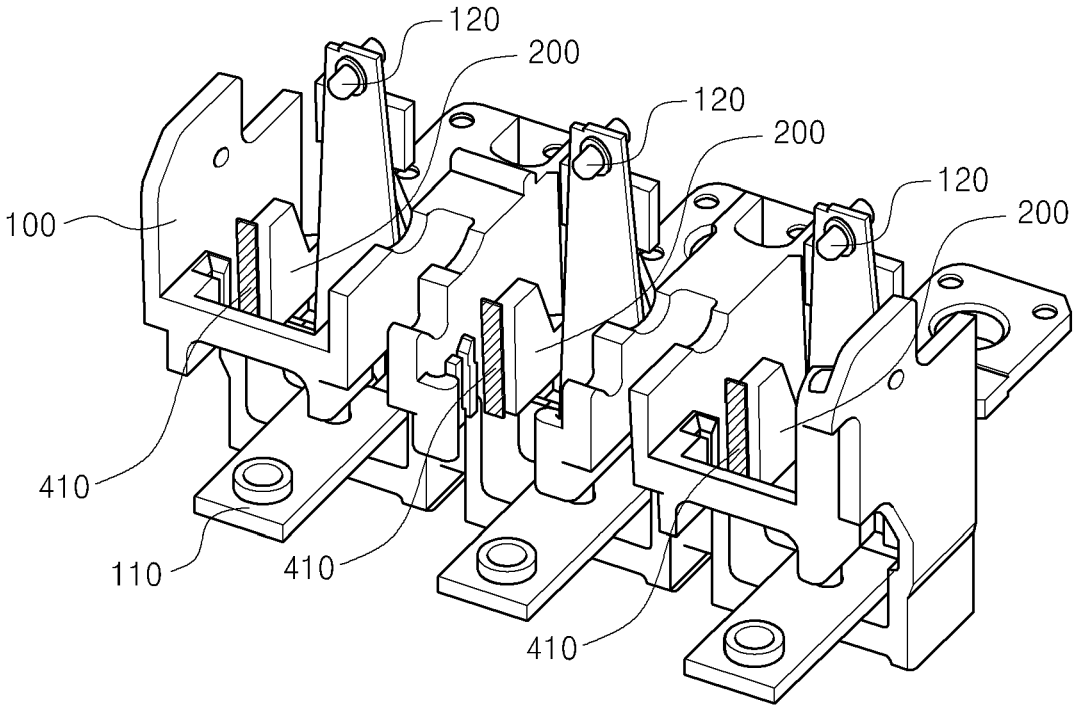
FIG. 6 is a perspective view of the instant trip apparatus of the molded case circuit breaker according to an embodiment.
Figure 7:
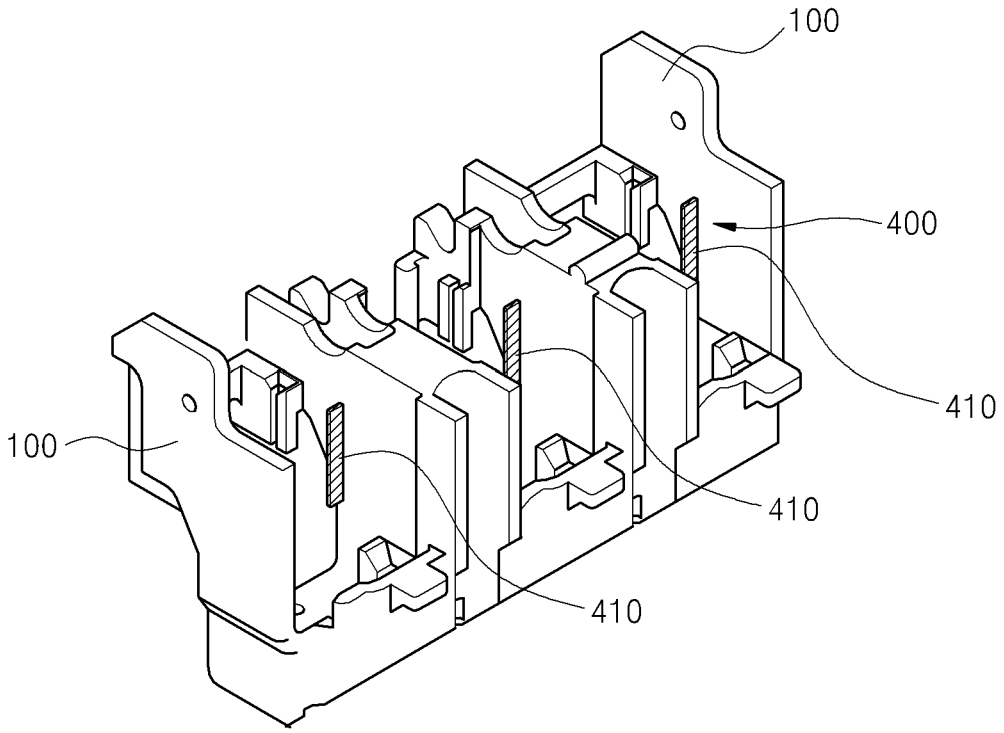
FIG. 7 is a perspective view illustrating an installed state of a rotation restriction member according to an embodiment.

FIG. 5 is a view of an instant trip apparatus of a molded case circuit breaker according to an embodiment, FIG. 6 is a perspective view of the instant trip apparatus of the molded case circuit breaker according to an embodiment, and FIG. 7 is a perspective view illustrating an installed state of a rotation restriction member according to an embodiment.

Referring to FIGS. 5 and 6, the instant trip apparatus of the molded case circuit breaker according to an embodiment includes a case 100, a magnet part 200, an armature part 300, and a gap maintenance part 400.

The case 100 may define an outer appearance of the instant trip apparatus of the molded case circuit breaker. The case 100 may be formed of an insulation material, and a heater 110 is disposed on a bottom surface of an inner space of the case 100.

The magnet part 200 may be disposed in the case 100. The magnet part 200 may be disposed above the heater 110. The magnet part 200 may be provided as an electromagnet that detects overcurrent or accident current to generate magnetic attractive force when the overcurrent or accident current flows through a circuit (not shown) of the circuit breaker. The magnet part 200 may generate the magnetic attractive force while the accident current flows therethrough.

The armature part 300 is disposed in the case 100 to face the magnet part 200.

The armature part 300 includes an armature 310, a support 320 for guiding rotation of the armature 310, and an armature spring 300 for allowing the armature 310 to return to its original position.

The armature 310 may be disposed to face the magnet part 200 in a state in which the armature 310 is rotatably connected to the support 320. The armature 310 may rotate around a rotation center toward the magnet part 200 and rotate in a direction opposite to the magnet part 200. The armature 310 may include a plate body having a plate shape. The armature 310 may further include a rotation shaft 311 that serves as the rotation center. The rotation shaft 311 may protrude from an extension part that extends from a lower portion of the plate body. The armature 310 has a lower end that is rotatably connected to the support 320. The armature 310 rotates by using the support 320 as a rotation center. The armature 310 rotates toward the magnet part 200 by the magnetic attractive force.

A support member 340 for connecting the armature spring 330 may be disposed around the armature 310.

The support 320 may be disposed in the case 100 or on the heater 110 to guide the rotation of the armature 310. The support 320 may be disposed to be spaced apart from the magnet part 200. The support 320 may be disposed above the heater 100 to rotatably support the rotation shaft 311 disposed on a lower portion of the armature 310.

The armature spring 330 may have one end connected to a spring connection part disposed on the armature 310. If external force is not applied, the armature spring 330 may pull the armature 310 in a direction that is away from the magnet part 200, and the armature 310 may return to its original position by the armature spring 330. Here, the original position may denote a position at which the armature 310 is spaced apart from the magnet part 200. The armature spring 330 may have an upper end connected to an upper end of the armature 310 and a lower end connected to a lower end of the support member 340. The armature spring 330 may allow the armature 310 to elastically return to its original position when the magnetic attractive force generated by the magnet part 200 is removed.

The crossbar 500 is vertically rotatably disposed above the armature part 300 in the case 100. The crossbar 500 may be disposed in the case 100 to rotate between the original position and a trip position.

The crossbar 500 may be disposed in the case 100 to rotate between the original position and the trip position and may rotate to the trip position by the armature 310 and elastically return to the original position by the crossbar spring 520 disposed at the rotation center of the crossbar 500.

The original position of the crossbar 500 may be a position in a normal state, and the trip position may be a position rotating in a counterclockwise direction from the original position.

In the position in the normal state, the lower end of the crossbar 500 may be disposed between the armature 310 and the magnet part 200.

Here, the lower end of the crossbar 500 may be a portion at which the armature 310 rotates in a clockwise direction and which is pressed and pushed to contact the rotating armature 310.

The gap maintenance part 400 may maintain a gap defined between the armature 310 and the magnet part 200. The gap maintenance part 400 may prevent the armature 310 and the magnet part 200 from contacting each other to maintain the gap therebetween. The gap maintenance part 400 may restrict the rotation of the armature 310.

The gap maintenance part 400 may restrain the armature 310 so that the armature 310 does not rotate at a predetermined angle or more. The armature 310 may not rotate at a predetermined angle or more toward the magnet part 200 by the restriction of the gap maintenance part 400, and the gap maintenance part 400 may restrict excessive rotation of the armature 310.

The gap maintenance part 400 may include a rotation restriction member 410 that is disposed to be exposed to an armature rotation path between the armature 310 and the magnet part 200.

The rotation restriction member 410 may have a plate shape as illustrated in FIGS. 6 and 7. The rotation restriction member 410 may restrict the contact between the armature 310 and the magnet part 200 in a state in which the rotation restriction member 410 is disposed around the armature part 300.

The rotation restriction member 410 is disposed on an inner sidewall of the case 100 at a side of the armature part 300.

The rotation restriction member 410 has a plate shape. The rotation restriction member 410 may have a rectangular plate shape and be longitudinally disposed in a direction perpendicular to a top surface of the heater 110.

The rotation restriction member 410 may be detachably or integrally disposed on the case 100. When the rotation restriction member 410 is integrated with the case 100, the rotation restriction member 410 may be manufactured through injection or insertion injection molding.

The rotation restriction member 410 may protrude from the inner sidewall of the case 100 and be disposed to protrude from the case 100 to the armature rotation path. The rotation restriction member 410 may have a lower end that is disposed in the rotation path of the armature 310. When the armature 310 rotates to one surface of the magnet part 200, the rotation restriction member 410 may contact the one surface of the armature 310 to restrict the rotation of the armature 310. That is, the rotation restriction member 410 may serve as a stopper for the armature 310.

The rotation restriction member 410 may have a thickness to form a gap G. The thickness of the rotation restriction member 410 may be determined by the gap G (see FIG. 8) between the one surface of the armature 310 and the magnet part 200. Here, the rotation restriction member 410 may be formed of a metal or insulation material.

Non-explained reference numeral "120" in FIG. 5 denotes a bimetal. When current flowing through the heater 110 is over rated current (overcurrent), the bimetal 120 is bent by the generated heat to push the crossbar 500 so that the crossbar 500 rotates to the trip position.

The rotation restriction member 410 may press the crossbar 500 that is disposed at the normal position to allow the crossbar 500 to rotate. Also, the rotation restriction member 410 may be disposed at a predetermined position with a predetermined thickness to maintain the gap G defined by the armature 310 and the magnet part 200.

Next, an operation of the instant trip apparatus of the molded case circuit breaker according to an embodiment will be described with reference to the above-described constituents.

Figure 8:
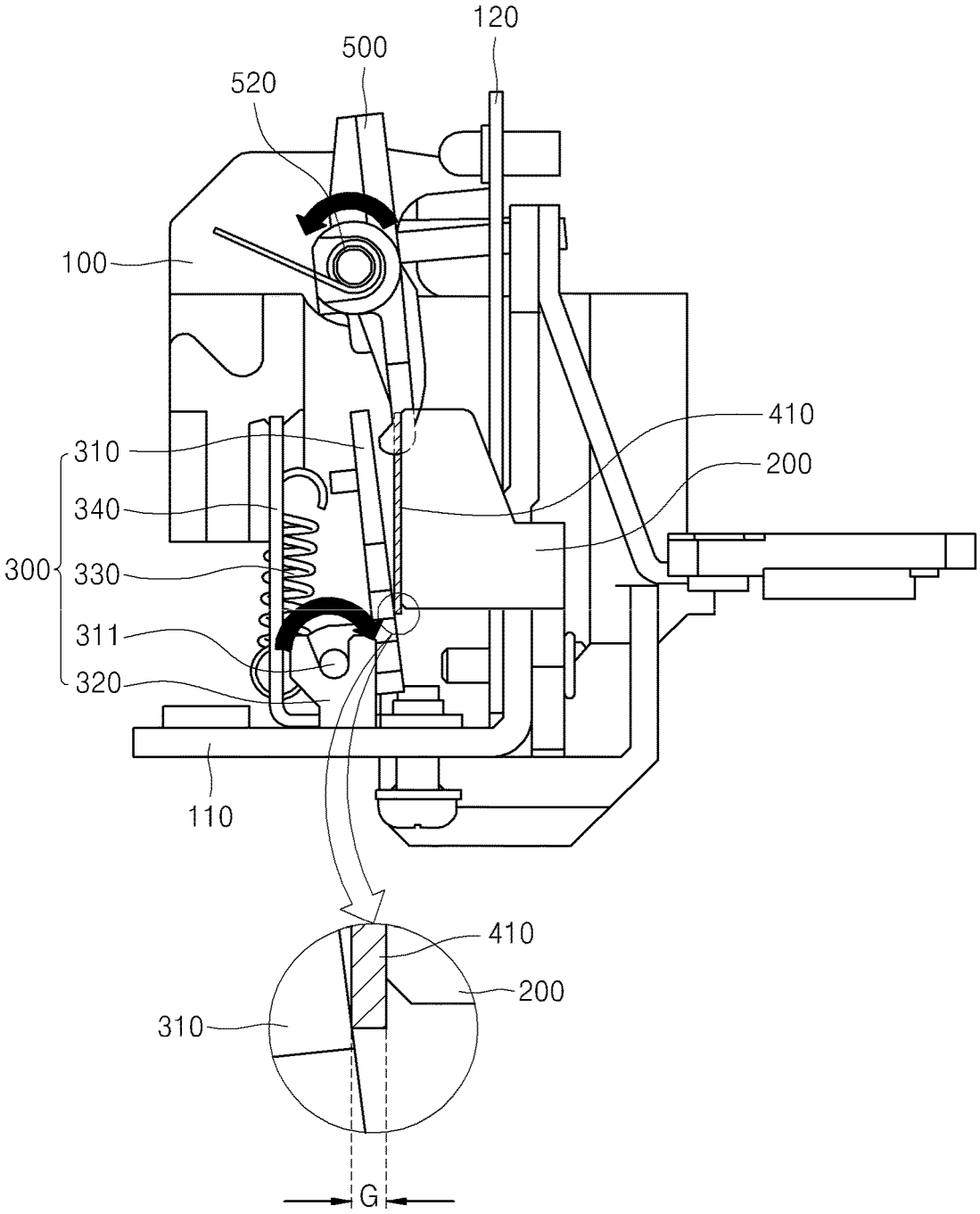
FIG. 8 is a view illustrating an instant trip operation of the instant trip apparatus according to an embodiment.

FIG. 8 is a view illustrating an instant trip operation of the instant trip apparatus according to an embodiment.

Referring to FIG. 8, the armature 310 may be maintained to a state in which the armature 310 is spaced apart form the magnet part 200 at a position at which the armature 310 faces one surface of the magnet part 200. Here, the armature spring 330 may elastically connect the armature 310 to the support member 340 without being tensioned.

The accident current (e.g., current greater by several ten times than the rated current) may be transmitted to the heater 110, and the magnet part 200 connected to the circuit (not shown) of the circuit breaker may generate the magnetic attractive force.

The armature 310 rotates to the one surface of the magnet part 200 by using the support 320 connected to the lower end thereof as the rotation center.

The upper end of the armature 310 rotating as described above may push the lower end of the crossbar 500 disposed in the normal state in a counterclockwise direction to rotate. The rotating crossbar 500 may rotate in the counterclockwise direction by the operation of the armature 310 and then be disposed at the trip position. Thus, the instant trip operation may be performed.

Also, the armature 310 rotating by the magnetic attractive force may contact the rotation restriction member 410 having the plate shape and disposed on the side of the magnet part 200 and thus be restricted in rotation.

Here, one surface of the armature 310 may contact an edge of the lower end of the rotation restriction member 410 and define the gap G together with the magnet part 200 by the thickness of the rotation restriction member 410.

Thus, the armature 310 and the magnet part 200 may not contact each other, and the accident current may not flow along the following path: the heater 100->the support 32->the armature 310->the magnet part 200.

Also, since the armature 310 and the magnet part 200 do not contact each other, the fusing therebetween may not occur.

When the accident current is completely removed by the instant trip operation, the magnetic attractive force generated by the magnet part 200 may be lost. Thus, the armature 310 may rotate to return to the original position by the elastic restoring force of the armature spring 330.

Furthermore, the crossbar 500 may also rotate to the original position, i.e., the normal position by the elastic restoring force of the crossbar spring 520.

Thus, after the instant trip operation, the armature 310 and the crossbar 500 may easily return to their original positions, and thus, the circuit breaker may be normally used.

In the above-described example, the structure in which the rotation restriction member 410 protrude from the inner sidewall of the case 100 in the direction perpendicular to the top surface of the heater 110 was described as a representative example.

Furthermore, the rotation restriction member according to an embodiment may be realized in various shapes to maintain the gap G, like the following embodiment.

Figure 9:
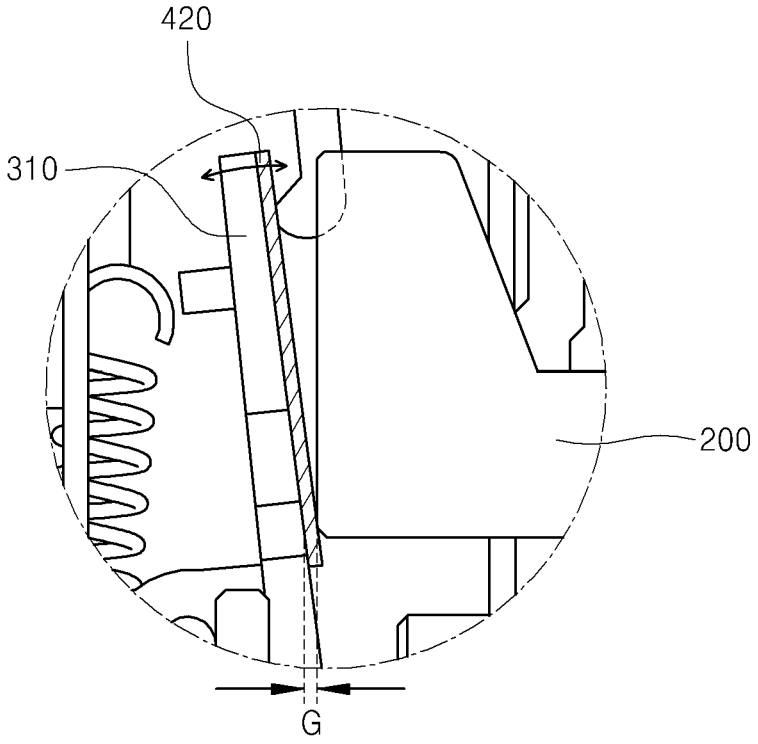
FIG. 9 is a view illustrating another example of the rotation restriction member according to an embodiment.

FIG. 9 is a view illustrating another example of the rotation suppression member according to an embodiment.

Referring to FIG. 9, a rotation restriction member 420 may have a plate shape to surface-contact one surface of the armature 310 that rotates to a position for forming the gap. The rotation restriction member 420 may be an inclined plate that is inclinedly disposed to surface-contact the one surface of the armature 310 that rotates along the rotation path. The rotation restriction member 420 that is provided as the inclined plate may protrude to be inclined at a predetermined angle with respect to a front surface of the magnet part 200 on the inner sidewall of the case 100.

In this case, when the accident current occurs, the one surface of the armature 310 rotating toward the magnet part 200 may contact the one surface of the rotation restriction member 420 that is inclinedly disposed and thus be restricted in rotation. Here, the armature 310 and the magnet part 200 may form a gap G that corresponds to a thickness of the rotation restriction member 420.

In this embodiment, the armature 310 and the rotation restriction member 420 may surface-contact each other to restrict the rotation of the armature 310. Thus, an impact applied due to the contact between the rotation restriction member 420 and the rotating armature 310 may be dispersed to prevent the rotation restriction member 420 from being damaged or dislocated in position by the impact.

An occurrence of a non-uniform gap G between the armature 310 and the magnet part 200 when the rotation restriction member 420 is damaged or deformed may be prevented. In addition, even through the gap G is reduced, the fusion between the armature 310 and the magnet part 200 due to the contact therebetween may be efficiently solved.

Figure 10:
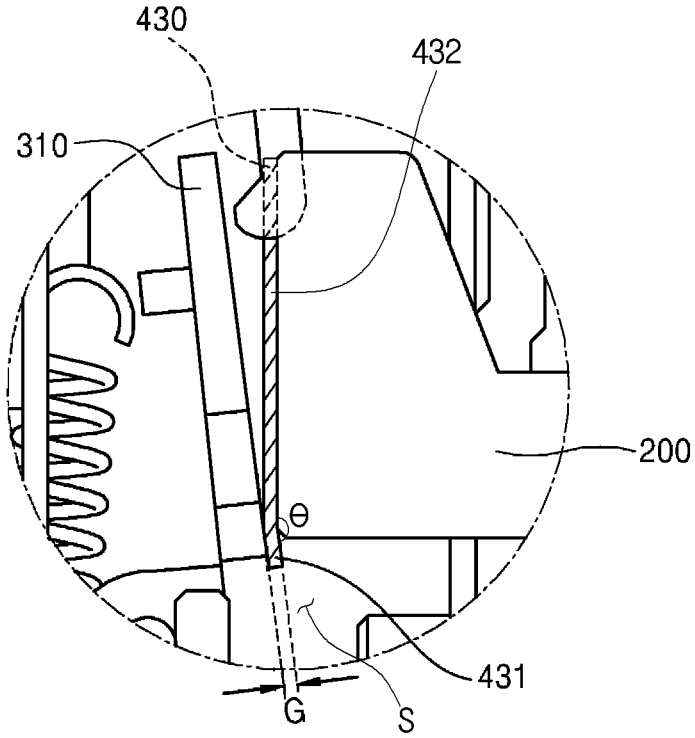
FIG. 10 is a view illustrating a modified example of the rotation restriction member according to an embodiment.

FIG. 10 is a view illustrating a modified example of the rotation restriction member according to an embodiment.

Referring to FIG. 10, a rotation restriction member 430 has a plate shape. A portion of a lower portion of the rotation restriction member 430 may be provided as an inclined plate 431 so that the rotation restriction member 430 surface-contacts one surface of the armature 310 that rotates to the position for forming the gap.

The rotation restriction member 430 may further include a vertical plate 432 that is longitudinally disposed in a vertical direction. The inclined plate 431 may be bent from a lower end of the vertical plate 432. The inclined plate 431 may be bent from the lower end of the vertical plate 432 at an obtuse angle θ with respect to the vertical plate 432. The inclined plate 431 may have a lower end that is inclined to an empty space S that is defined under the magnet part 200.

When the accident current occurs, one surface of the rotating armature 310 may surface-contact one surface of the inclined plate 431, which faces the armature 310. The one surface of the armature 310 may not surface-contact all of the one surface of the vertical plate 432 and the one surface of the inclined plate 431, but may surface-contact only the one surface of the inclined plate 431. The inclined plate 431 may elastically absorb an impact when contacting the armature 310 due to the rotation of the armature 310.

In this case, since the inclined plate 431 of the rotation restriction member 430 and the armature 310 surface-contact each other, the impact generated due to the contact with the rotating armature 310 may be dispersed to prevent the rotation restriction member 430 from being damaged and deformed by the impact.

Thus, when the accident current occurs, the gap G between the rotating armature 310 and the magnet part 200 may be uniformly maintained.

Figure 11:
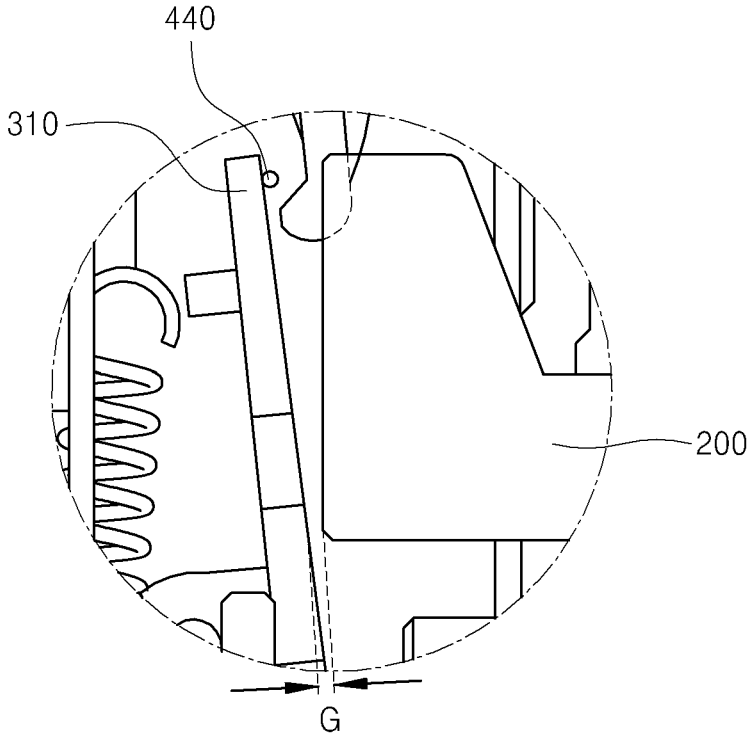
FIG. 11 is a view illustrating another example of the rotation restriction member according to an embodiment.

FIG. 11 is a view illustrating another example of the rotation suppression member according to an embodiment.

Referring to FIG. 11, a rotation restriction member 440 may include a protrusion. The protrusion may have a cylindrical shape. The protrusion may be disposed in the armature rotation path. The protrusion may protrude from the inner sidewall of the case 100 so that the protrusion is disposed in the rotation path of the armature 310. The protrusion may be disposed to be spaced apart from each of the magnet part 200 and the armature 310 in the rotation path.

The rotation restriction member 440 including the protrusion may have a diameter that is the same as the gap G defined between the armature 310 and the magnet part 200.

Thus, when the accident current occurs, the rotating armature 310 may contact an outer surface of the rotation restriction member 440 including the protrusion having the cylindrical shape and thus be restricted in rotation. Also, the armature 310 together with the magnet part 200 may define the gap G that corresponds to the diameter of the rotation restriction member 440 to non-contact the one surface of the magnet part 200.

In addition, although not shown, an auxiliary rotation restriction member (not shown) may be detachably inserted into the protrusion of the rotation restriction member 440 of FIG. 11. The auxiliary rotation restriction member may have a ring shape. The auxiliary rotation restriction member may constitute the rotation restriction member 440 together with the protrusion for increasing the whole size of the rotation restriction member 440, i.e., the gap G.

Thus, the above-described gap G may vary according to the diameter of the auxiliary rotation restriction member that is inserted around the rotation restriction member 440.

A plurality of auxiliary rotation restriction members may be successively inserted. The plurality of auxiliary rotation restriction members may have diameters that increase in stages. Also, the more the number of auxiliary restriction members to be inserted increases, the more the gap G may increase in size.

That is, when it is intended to increase the gap G, the number of auxiliary rotation restriction members that are successively inserted may increase. This may be applied to the process for manufacturing the circuit breaker.

In this embodiment, it may be possible to maintain the gap G by using only the protrusion without using the auxiliary rotation restriction member.

Figure 12:
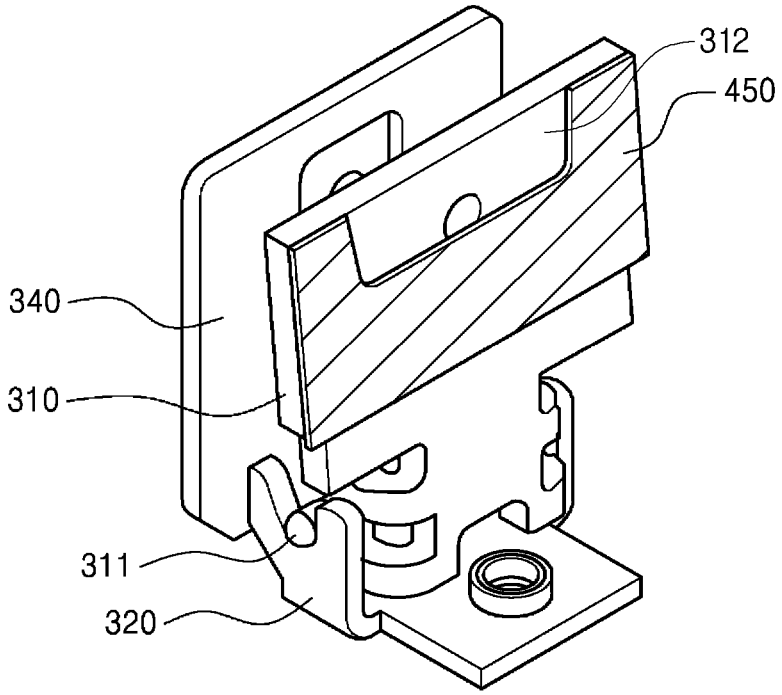
FIG. 12 is a view illustrating another example of a gap maintenance part according to an embodiment.

FIG. 12 is a view illustrating another example of the gap maintenance part according to an embodiment.

Referring to FIG. 12, the gap maintenance according to an embodiment may include an insulation member 450.

The insulation member 450 may be attached to one surface of the armature 310. The insulation member 450 may be disposed on a surface of both surfaces of the armature 310, which faces the magnet part 200 and be formed of an insulation material.

The insulation member 450 may be an insulation paper having a thickness for forming the above-described gap G or an insulation plate.

When the insulation member 450 is provided as the insulation paper, the insulation member 450 may be attached by using a double-sided tape. When the insulation member 450 is provided as the insulation plate, the insulation member 450 may be coupled by using a bolt.

The insulation member 450 may have a size that corresponds to the whole area of the one surface of the armature 310. Also, the insulation member 450 may be provided in a pair and thus be respectively disposed on both sides of the one surface of the armature 310. The insulation member 450 may surface-contact one surface of the magnet part 200. The insulation member 450 may be disposed to be spaced apart from one surface of each of the plurality of armatures 310.

The insulation member 450 may have a plate shape to cover a portion of the one surface of the armature 310. When the insulation member 450 covers the portion of the one surface of the armature 310, material costs may be reduced when compared to a case in which the insulation member 450 cover the whole one surface of the armature 310.

The insulation member 450 may be disposed on a portion of the one surface of the armature 310 except for a portion of the one surface of the armature 310 contacting the crossbar 500. In this case, the portion of the one surface of the armature 310, which is covered by the insulation member 450 may be a non-contact part that is covered by the insulation member 450. Also, the portion of the one surface of the armature 310, which is not covered by the insulation member 450 may be an exposed contact part 312 that contacts the crossbar 500 to rotate the crossbar 500.

When the incident current occurs, if the armature 310 rotates to one surface of the magnet part 200 along the rotation path, the insulation member 450 disposed on the one surface of the armature 310 may substantially contact the one surface of the magnet part 200. The insulation member 450 may surface-contact the magnet part 200 when contacting the magnet part 200. When the armature 310 rotates to the magnet part 200, the insulation member 450 may surface-contact the magnet part 200.

The insulation member 450 may have a thickness for forming the gap G independently. Thus, the armature 310 and the magnet part 200 may be in the non-contact state by the gap G that corresponds to the thickness of the insulation member 450.

The insulation member 450 may include at least one buffer protrusion facing the magnet part 200. The buffer protrusion may reduce an impact when contacting the magnet part 200. The buffer protrusion may be provided in plurality to protrude from a surface of the insulation member 450 facing the magnet part 200.

In this embodiment, like the foregoing embodiment, the heater 110 may be further disposed on the bottom surface of the inner space of the case 100. The magnet part 200 may be disposed above the heater 110, and the insulation member may contact the magnet part 200 at an upper side of the heater 110.

The insulation member 450 may form the gap G together with the rotation restriction member of FIGS. 5 and 11. In this case, the sum of a thickness of the insulation member 450 and a thickness of the rotation restriction member of FIGS. 5 and 11 may be a thickness for forming the gap G. When the armature 310 rotates to the magnet part 200, the insulation member 450 may contact the rotation restriction member of FIGS. 5 and 11. The armature 310 may non-contact the magnet part 200 with the insulation member 450 and the rotation restriction member 450 therebetween.

That is, the insulation member 450 may maintain the gap G while surface-contacting the rotation restriction member of FIGS. 5 and 11.

In the above-described structure and operation, according to the embodiment, when the accident current flows, the gap between the magnet part and the armature that rotates to the armature may be uniformly maintained to prevent the contact and fusion therebetween from occurring. Also, the accident current may be diverted around the magnet part and thus broken.

Also, after the accident current is broken, the armature may elastically return to its original position. Thus, the crossbar may return to the normal position to secure the reliability in effective instant trip operation.

Also, the rotation restriction member for restricting the rotation of the armature may surface-contact the one surface of the armature to restrict the rotation of the armature, thereby preventing the rotation restriction member from being changed in position or damaged. Thus, when the accident current occurs, the gap may be uniformly maintained.

Also, according to the embodiment, the rotation restriction member having the protrusion shape may be provided and disposed at a variable position in the case. Thus, when the rotation of the armature is restricted, the gap between the magnet and the armature may be variably adjusted.

According to the embodiments, if the accident current flows, the gap may be generated between the armature, which rotates to the magnet part, and the magnet to prevent the armature and the magnet part from contacting and being fused with each other.

Also, the accident current may be induced so that the accident current does not flow to the magnet part, and the malfunction due to the accident current may be prevented.

Also, after the accident current is broken, the armature may elastically return to its original position. Thus, the crossbar may return to the normal position to secure the reliability in effective instant trip operation.

Also, the rotation restriction member for restricting the rotation of the armature may surface-contact the one surface of the armature to restrict the rotation of the armature, thereby preventing the rotation restriction member from being changed in position or damaged. Thus, when the accident current occurs, the gap may be uniformly maintained.

Also, the gap between the magnet and the armature may be variably adjusted by the protrusion and the auxiliary rotation restriction member, and the gap may be optimally managed and maintained.

Also, the insulation member may not interrupt the contact between the armature and the crossbar, but may help the smooth rotation of the crossbar.

Although the preferred embodiment with respect to the instant trip apparatus of the molded case circuit breaker is described above, it will be understood by those skilled in the art that various changes in form and details may be made therein without departing from the spirit and scope of the invention as defined by the appended claims.

Therefore, the scope of this disclosure is defined not by the detailed description of the invention but by the appended claims, and all differences within the scope will be construed as being included in the present disclosure.

Accordingly, the scope of the present disclosure is defined by the appended claims rather than the foregoing description and the exemplary embodiments described therein. Various modifications made within the meaning of an equivalent of the claims of the invention and within the claims are to be regarded to be in the scope of the present disclosure.

What is claimed is:

1. An instant trip apparatus of a molded case circuit breaker, the instant trip apparatus comprising:

a case;

a magnet part disposed in the case and configured to generate a magnetic attractive force when an accident current flows therethrough;

an armature disposed to face the magnet part and configured to rotate toward the magnet part by the magnetic attractive force;

an armature spring configured to bias the armature to its original position; and a gap maintenance part configured to restrict the rotation of the armature so that a gap defined between the armature and the magnet part is maintained when the accident current occurs, wherein the gap maintenance part comprises a rotation restriction member that is disposed to be exposed to a path of rotation of the armature between the armature and the magnet part, and wherein the rotation restriction member protrudes from an inner surface of the case and at least a portion of the protruding rotation restriction member is exposed to the path of rotation of the armature.

2. The instant trip apparatus according to claim 1, wherein the rotation restriction member the gap is defined based on a thickness of the rotation restriction member.

3. The instant trip apparatus according to claim 1, further comprising a heater disposed at a bottom surface of an inner space of the case, wherein the magnet part is disposed above the heater and the rotation restriction member is longitudinally disposed in a direction perpendicular to a top surface of the heater.

4. The instant trip apparatus according to claim 1, wherein the rotation restriction member is configured in a plate shape and comprises a surface which contacts a corresponding surface of the armature to define the gap.

5. The instant trip apparatus according to claim 1, wherein the rotation restriction member comprises an inclined plate that is inclinedly disposed on the case to surface-contact one surface of the armature.

6. The instant trip apparatus according to claim 1, wherein a portion of the rotation restriction member comprises an inclined plate that is inclined to surface-contact one surface of the armature rotating to a position for defining the gap.

7. The instant trip apparatus according to claim 6, wherein the inclined plate has a lower end that is inclined to an empty space defined under the magnet part.

8. The instant trip apparatus according to claim 7, wherein the rotation restriction member further comprises a vertical plate that is longitudinally disposed in a vertical direction, and the inclined plate is bent from a lower end of the vertical plate at an obtuse angle with respect to the vertical plate.

9. The instant trip apparatus according to claim 1, wherein the rotation restriction member comprises:

a protrusion disposed in the armature rotation path; and an auxiliary rotation restriction member detachably inserted into the protrusion.

10. The instant trip apparatus according to claim 9, wherein the protrusion has a cylindrical shape, and the auxiliary rotation restriction member has a ring shape.

11. The instant trip apparatus according to claim 9, wherein the protrusion is disposed to be spaced apart from each of the magnet part and the armature in the armature rotation path.

12. The instant trip apparatus according to claim 9, wherein the auxiliary rotation restriction member is provided in plurality, and the plurality of auxiliary rotation restriction members have diameters that increase in stages.

13. The instant trip apparatus according to claim 1, wherein the gap maintenance part is disposed on a surface of both surfaces of the armature, which faces the magnet part and further comprises an insulation member formed of an insulation material.

14. The instant trip apparatus according to claim 13, further comprising a crossbar disposed to be rotatable between the original position and a trip position in the case, the crossbar rotating to the trip position by the armature, wherein the insulation member is disposed on a portion of one surface of the armature except for a portion at which the armature contacts the crossbar.

* * * * *